United States Patent [19]

Nordmann

[11] Patent Number: 4,773,912

[45] Date of Patent: Sep. 27, 1988

[54] PROCESS FOR INCREASING THE PERFORMANCE OF PLEATED SILK OR WOOL BY TREATMENT WITH KERATOLYTIC LIQUOR AND IMPREGNATING WITH GLAZING POWDER AND HEATING

[76] Inventor: Heidelinde Nordmann, ABC-Strasse 1, D-2000 Hamburg 36, Fed. Rep. of Germany

[21] Appl. No.: 948,432

[22] Filed: Dec. 31, 1986

Related U.S. Application Data

[63] Continuation of Ser. No. 801,935, Nov. 26, 1985, abandoned.

[30] Foreign Application Priority Data

Nov. 28, 1984 [DE] Fed. Rep. of Germany ..... 3443327

[51] Int. Cl.[4] ..... D06C 7/04; D06M 3/06; D06M 11/12; B01T 35/06

[52] U.S. Cl. ..... 8/128.1; 8/115.54; 8/115.56; 8/115.68; 8/115.69; 8/115.7; 8/116.1; 8/127.5

[58] Field of Search ..... 8/127.6, 115.56, 128 R, 8/127.5, 115.68

[56] References Cited

U.S. PATENT DOCUMENTS

| | | | |
|---|---|---|---|
| 3,005,730 | 10/1961 | Pardo et al. | 427/412 |
| 3,686,026 | 8/1972 | Schafer et al. | 117/141 |

FOREIGN PATENT DOCUMENTS

| | | |
|---|---|---|
| 679465 | 7/1939 | Fed. Rep. of Germany . |
| 967641 | 7/1949 | Fed. Rep. of Germany . |
| 905967 | 7/1949 | Fed. Rep. of Germany . |
| 1110606 | 3/1959 | Fed. Rep. of Germany . |
| 1127861 | 4/1962 | Fed. Rep. of Germany . |
| 1138371 | 10/1962 | Fed. Rep. of Germany . |
| 1146029 | 3/1963 | Fed. Rep. of Germany . |
| 453700 | 10/1936 | United Kingdom . |
| 1474105 | 5/1974 | United Kingdom . |
| 1565199 | 4/1980 | United Kingdom . |

*Primary Examiner*—A. Lionel Clingman
*Attorney, Agent, or Firm*—Cushman, Darby & Cushman

[57] ABSTRACT

A process for the treatment of textile materials consisting of or containing natural vegetable or animal fibres, in which (a) ketatolytic liquid is allowed to act on the textile material, and then washed out, then preferably the material is further treated with an oxidizing agent which thereafter is washed out, (b) the textile material is impregnated with a suspension of a finely-divided frit or glazing powder, and (c) the impregnated material is subjected to heat-treatment at a temperature of above 180° C.

19 Claims, No Drawings

PROCESS FOR INCREASING THE PERFORMANCE OF PLEATED SILK OR WOOL BY TREATMENT WITH KERATOLYTIC LIQUOR AND IMPREGNATING WITH GLAZING POWDER AND HEATING

This is a continuation of application Ser. No. 801,935, filed Nov. 26, 1985, which was abandoned upon the filing hereof.

This invention relates to a process for improving the properties of textile materials which consist of or contain natural vegetable or animal fibres.

BACKGROUND OF THE INVENTION

Many processes are known for the treatment of textile materials in which either one somehow influences or changes the structure of the textile fibres themselves, or one treats the textile fibres with chemicals which will be more or less strongly absorbed thereon. All the well-known processes of this kind do no doubt improve one or other of the properties of the textile materials thus treated, but these treatments seem inevitably to cause other properties to deteriorate.

It is thus known for instance in the permanent-waving or crimping of straight hair, to treat either human hair or even wool with keratolytic agents, then to shape the hair or wool and finally to fix or oxidize the shaped hair, as is described for example in GB-PS No. 453 700.

It is also known, as described in DE-OS No. 26 53 958, to impart so-called permanent trouser creases to trousers made from keratin-containing fibres by treating the relevant areas with reducing agents so as to open the disulphide linkages, the desired creases being then pressed in and set or hardened. Unfortunately however it is not possible by this procedure to achieve a really permanent shaping, in the sense of a pleating or crease formation which is maintained even after wetting or actual washing.

Attempts have been made, for example as described in DE-OS No. 20 25 454, to polymerize vinyl polymers onto wool fibres or the hair; or, as described in DE-AS No. 16 15 166, to polymerise N-vinylpyrrolidone onto wool fibres or the hair. Similarly, in order to make wool shrink-proof, the polymerization thereon of other synthetics such as acrylamide has been proposed, as described in U.S. Pat. No. 3,005,730. These procedures, however, yield woollen materials which have a "hard" feel to them and which will drape only stiffly—they are quite unsuitable for use on softly draping silk.

It is furthermore also known, for example from DE-AS No. 1 106 725, to treat cellulosic woven fabrics with thiodiglycols and an acid catalyst so as to improve their crease resistance, and after drying to heat them to about 170° C. in order to harden the cellulose by exchange between the sulphide residue and the OH-groups of the cellulose in the fibres; and in polyurethane finishing it is possible to replace the thiodiglycols according to DE-AS Nos. 1 146 029 and 1 110 606 with polyepoxides or other polymerisation products, or according to DE-PS No. 9 67 641, DE-OS No. 24 21 888, DE-OS No. 28 37 081 and DE-AS No. 19 16 331, with isocyanate polyaddition products with an amine compound. These procedures however are at best only suitable for cellulosic fibres, and are not at all suitable for wool and silk; while even the cellulosic materials thus treated have a bad "feel" to them.

Broadly similar processes have been proposed, and recommended also for polyurethane finishing, in which a permanent pleating effect is achieved by means of treatment with an urethane emulsion as described in DE-OS Nos. 23 60 050, 24 30 508, 25 51 436 or 19 09 095; and the procedure can be further improved according to DE-OS No. 25 38 020 by the use of a reducing agent of the bisulphide type. However, all these procedures, which depend on the use of polymerisates, tend to spoil the soft "feel" of woollen textiles treated in this way.

Finely-divided metal oxides, particularly aluminum oxide, have been used to improve the abrasion-resistance of textile materials, as described in DE-OS No. 16 19 088, DE-AS No. 1 127 861 and 1 138 371, but polyethylene or another film-former is then needed to be present to ensure fixation of the metal oxide. Metal oxides have also been used in suspension, according to DE-PS Nos. 679 465 and 905,967, to impart a matt finish to textiles. These proposals however have given no improvement in shape-retention, to the textile materials.

SUMMARY OF THE INVENTION

It is the object of this invention to provide a process for the treatment of textiles which will result in an improvement of practically all of the desired properties of the textile material; and which will in particular improve the shape-retention of preformed textiles, such for example as pleated silk material, and their temperature resistance. It is a subsidiary object of the process of the present invention to make it easier to care for the textile material, and in particular to render it colour-fast on boiling, to impart resistance to fading and to protect textile materials, in particular, such as wool, against shrinking and felting.

According to the invention there is provided a process for improving the properties of textile materials which consist of or contain natural vegetable or animal fibres, in which the textile material is subjected to the steps of:

(a) treatment with a keratolytic liquid of the kind used for the permanent-waving of human hair, which after it has acted on the textile material is then washed out thereof;

(b) impregnation with a suspension of a finely-divided glazing powder of the kind used in ceramics as a glazing material; and (c) heat-treatment of the thus-treated textile material at a temperature of above 180° C.

The term "textile materials" is used herein to embrace threads, yarns or fleeces as well as knitted and woven fabrics, which consist of or contain natural vegetable or animal fibres, such as especially silk, wool and cotton.

Textile materials which have been treated by the process of the invention can find use in many obvious ways, for instance in the fashion or other clothing trades and as furnishing or other decorative materials, but they are also suitable for many industrial purposes. In the fashion and other clothing trade there has been a long-felt but largely unfulfilled need to be able to shape preformed materials, for example ironed and pleated materials, in such a way that the shaping would remain unaffected by water, whether in washing or when splashed with water, and also by chemical cleaning. This need arises particularly in connection with pleated silk and pleated woollen materials. It is therefore a notable feature of this invention that pleated or otherwise shaped materials treated by the process of this invention maintain their shape-retention even on washing at higher temperatures or upon chemical cleaning. Another remarkable consequence of the process of the invention is that it seems to prevent felting or woollen materials; and equally with mixed weaves, the process seems to prevent any differential shrinkage.

The industrial uses of textile materials treated by the process of the invention spring in particular from their exceptionally high temperature-resistance, which can extend up to temperatures of 300° C. or even higher, and as a result of which quite surprisingly it becomes possible to use textile materials treated by the process of the invention as filter materials or catalyst supports even under difficult conditions of temperature and pressure. It is a further advantage of textile materials treated by the process of the invention, especially but not only for industrial purposes, that they are much more resistant to fungus attack and rotting; and that the colourfastness of the thus-treated textile materials is also improved.

Moreover, because of the excellent shape-retention exhibited by them, pile weave textile materials, such as for example velvet, when treated by the process of the invention will keep their structure unchanged and thus retain their natural appearance even after limited loading, without "pressure places" making an appearance.

As already indicated above, the process of this invention involves at least three fundamental treatment stages or process steps.

In the first of these fundamental process steps, the textile material is treated with a keratolytic liquid which is subsequently washed out; in the second fundamental process step, the textile material is impregnated with a suspension of a finely-divided glazing or frit powder; and in the third fundamental process step the textile material is submitted to heat-treatment at a temperature above 180° C. There are however certain preferred additional process steps beyond those three fundamental ones, as will be described below. It is especially preferred that after the first fundamental process step the textile material should be treated with an oxidizing agent, which is subsequently washed out, before the material is subjected to the second fundamental process step.

The keratolytic liquids employed in the process are those of the kind which may be used for the treatment of human hair as permanent-waving preparations. Particularly preferred such keratolytic liquids are alkali-metal sulphite solutions which have been adjusted to an alkaline pH value, or those which contain alkaline additives such as monoethanolamine, ammonia or urea; the pH-value of these keratolytic solutions will ordinarily lie above 8, for example between 9 and 10. Instead of thioglycol acids, solutions with ethanolamineammoniumthioglycolate or similarly-acting compounds such as guanidinethioglycolate can be used. In addition to can be used. In addition to glycerin-monomercaptan there can be used also glycolesters of the di- and tri-thiocarbonic acids in about 10% solutions, derivatives of thioacetic acids, formamidinsulphin acids and the like.

In the first fundamental step of the process the treatment of the textile fibres with keratolytic liquid must take place for a time sufficient to allow it to act thereon, and thus will vary in duration according to the type of keratolytic liquid employed and the type of fibre under treatment. In general the textile material should be left in contact with the keratolytic liquid for a period of from 10 to 40 minutes, e.g. for "Batist" for 25 minutes or longer up to a period of 1.5 to 3 hours after this liquid has been applied. Shorter periods of treatment can however be used with more highly concentrated keratolytic liquids, while equally it may be necessary to extend the period of treatment with less concentrated keratolytic liquids.

After the treatment with the keratolytic liquid, the latter is preferably squeezed off or otherwise physically removed from the textile material, and is finally washed out therefrom.

As previously indicated, the first step of the process is preferably followed by an additional step in which the textile material is treated with an oxidizing agent. At its simplest, this can be done by air, particularly if small quantities of metal salts, such as for example manganese salts, are added to the rinsing water. The most useful and therefore important oxidizing agents for use in this step are hydrogen peroxide, perborate and bromate; but others can also be used, such as urea peroxide and other per-compounds such as amino-1,3,5-triazinperhydrate or melaninperhydrate. In general it is possible to use as oxidizing or neutralizing agents in the process of this invention any of the solutions which are known as so-called fixing agents for the permanent-waving of human hair. After this oxidizing agent treatment, the resulting neutralized or fixed textile material should be freed from this oxidizing or neutralizing agent, conveniently by washing it out.

In the second fundamental step of the process of this invention, the textile material must be impregnated with a suspension of a finely-divided glazing or frit powder. Suitable frits or glazing powders are those generally known from the ceramic industry, which are premolten glazing compositions that have been choquecooled and pulverized. The suspensions will normally contain 0.5–10% of clay or bentonite acting as suspending agent. The softening point of such frits or glazing materials can be considerably reduced by including borates or alkali metal oxides therein. For further information about suitable frits and glazes reference is made to "Keramik Lexikon" or Gustav Weiss, Ullstein Verlag (1984) Berlin, the contents of which are incorporated herein.

The premier choice of frits and glazes for use in the process of the invention must fall on the metal oxides which are used in ceramics as glazing material, and certainly in the most varied compositions of basic, amphoteric or acid oxides, in which desirably there will also be included fluxing agents such as borates. It is advantageous to use glazing or frit powders based on basic oxides, in order to avoid excessively high melting temperatures. One class of preferred frits are the so-called lead frits, containing from about 70 to 80% of PbO, the remainder being $SiO_2$ and preferably up to 40% by weight of sodium borate in the form of borax crystals or calcined borax. Frits containing additions of zinc borate and calcium borate may also be used with advantage. Particularly suitable frits, because of their low melting point, are boron frits with a formula made up of PbO, 0.5 $SiO_2$, 1.5 $B_2O_2$. An equally preferred lead-free frit has the formula:

0.35 $K_2O$
0.35 $Al_2O_3$
0.28 CaO
0.28 ZnO
3.16 $SiO_2$
0.16 $B_2O_3$ 0.09 $Li_2O$

The glazing or frit powder is incorporated in the suspension as a fine powder with a particle size of preferably from 10 to 400 μm, although finely divided powder with an average particle size below 10 μm can be used. The aqueous suspensions of the glazing or frit powder employed will preferably have a weight ratio in the range of 1:2 to 2:1, the optimum ratio being selected primarily to ensure that the suspension can be applied evenly to the textile material by whatever wiping-on or immersion method is to be used in the impregnation step.

The amount of glazing or frit powder applied can vary considerably. Suitable application rates will for example be from 0.5 to 5 g per $m^2$ for lengths of textiles, calculated in terms of the dry substance of the total metal oxides; or, if calculated on the basis of the weight of the textile materials, suitable application rates will range from 0.5 to 10% by weight. When the textile material is to be used for fashion or other clothing purposes or as furnishing or other decorative material, the amount applied should be at the lower end of those ranges, but when the textiles are to be used as temperature-resistant industrial cloth, it is then recommended to apply the suspension at the upper end of these ranges.

In the third fundamental step of the process of this invention the textile materials thus impregnated are submitted to heat-treatment at a temperature above 180° C. The impregnated textile material is preferably aid-dried before heat-treatment. The heat-treatment may advantageously be performed in a rotating oven, preferably at 250° to 350° C., or by drawing the textile material over an appropriately heated surface. In any given case the optimum heat-treatment will depend on the nature of the glazing or frit suspension and upon the intended end-use of the product. Thus, for example, when a silk weave is to be treated for an industrial end-use, higher proportions of glazing or frit powder can be employed and higher heat-temperatures can be used—and one then obtains a silk which is only slightly soft or smooth in character but which has a considerable temperature-resistance of above 300° C. For other end-uses, it is however possible to use a smaller amount of glazing or frit powder, and thus to get a soft and smooth silk material, which is still heat resistant up to 300° C. The heat treatment is preferably carried out by infra red heating.

It is an interesting and surprising fact that the impregnated textile materials can withstand the heat-treatment. Apparently the application of the frit has the effect of protecting the textile fibres against the heat-treatment, presumably because the frit material protects the fibres from decomposition both by heat-absorption and by its insulating effect.

After the the heat treatment the textile material will preferably be washed, particularly if it is to be used for fashion or other clothing applications or as furnishing or other decorative material.

All the washing steps, thus those undertaken after the treatment with the keratolytic liquid, and after the neutralizing or oxidizing step, and finally also after the heat treatment, can conveniently be carried out with water containing the usual anionic, cationic, amphoteric or non-ionic surface active agents, as well as other usual treatment additives.

A particularly attractive way of carrying out the process of the invention involves the use of glazing or frit powder which contains colouring metal oxides, such as, for example antimony oxide to impart yellow colours, manganese oxide to impart brown colours, copper oxide or iron oxide to impart red colours, cobalt oxide to impart blue colours, and chromium oxide or higher concentrations of manganese oxide to impart black colours. When using coloured suspensions of this sort it is also possible either to treat different areas of the textile materials with different suspensions or even just to squeeze out the suspension to a different extent in different places, and thus to secure correspondingly coloured or correspondingly shaded lengths of material, the resultant patterns of colour or shade being surprisingly good, fast and fade-resistant.

The reason for the improved properties imparted to textile materials by the process of this invention is not fully understood, and it is not wished to be here limited by any theoretical considerations; but it is assumed that the treatment with the keratolytic liquid makes the textile fibres receptive to the deposition in their microstructure of small metal oxide and/or other frit or glazing particles, which during the subsequent heat-treatment melt and afterwards re-solidify to fix the textile fibres relative to each other and thus impart the observed improvement in the properties of the whole textile material.

DESCRIPTION OF THE PREFERRED EMBODIMENTS

In order that the invention shall be well understood it will now be further explained with reference to the following examples:

EXAMPLE 1

In order to produce permanent pleating, a length of silk material was mechanically pleated with a 2 mm wide standing pleat, tacked through across the folds at 2 cm spacing, drawn closely together into a folded length, and fastened. The folded length was pre-wetted by dipping in water, after which it was wrung out. The folded length was then soaked in a keratolytic liquid having the following composition:

Keratolytic Liquid
Thioglycolic acid: 7.5% by weight
Ammonia (35%): 5.0% by weight
Wetting Agent: 0.1% by weight
Water, to make: 100.0%

[Note: The pH value of the keratolytic liquid was adjusted to 9.4 by means of monoethanolamine].

The textile material was left in contact with the keratolytic liquid at room temperature for 2.5 hours, after which the liquid was first squeezed out, and then washed out of the textile material with an anionic washing agent, for example one based on alkylarylsulphonate.

The folded length was then treated repeatedly with a suspension of a frit powder containing 78% PbO and the remainder $SiO_2$, and having a particle size in the region of 50 to 150 μm.

The folded length was then air-dried for about 1 hour, and thereafter drawn over ceramic rods heated to a temperature of about 300° C.; this heat-treatment was repeatedly carried out, alternately on the two sides of the folded length, until the folded length was quite dry.

The heat-treated material finally was vigorously washed out and dried in a drier, after which the tacking threads were removed.

The silk material thus treated was found to possess pleated folds which remained quite unaffected after chemical cleaning, and also practically unaffected even after washing at 60° C.; and it did not change its appearance even when splashed with water.

EXAMPLE 2

A woollen material was treated in essentially the same manner as in Example 1, except that after the first step and before the second step of the process the material was neutralized or oxidized with a bromate solution, and then again washed out as before.

The woollen material was impregnated in the second step of the process with about 3.8 g (calculated on the basis of the textile material after treatment had been completed) per $m_2$ of a finely divided PbO frit powder; and subsequently in the third stage it was heat-treated at 280° C. in an oven.

The resultant pleated woollen material showed absolutely no change on chemical cleaning; and showed practically no deterioration of the pleating after washing at 60° C. and subsequent drying in a drum drier.

EXAMPLE 3

An ultramarine-blue woollen material was treated in a manner similar to that described in Example 2. After the treatment with the keratolytic liquid and subsequent oxidation its colour value appeared a little brighter; and, after impregnation with the suspension of glazing or frit powder and the subsequent heat-treatment, this colour tone was maintained even after numerous washes.

EXAMPLE 4

A mixed silk-and-wool fabric was treated with the keratolytic liquid in a manner similar to that described in Example 1; and by thereafter wringing it out or some other mechanical crumpling procedure it was given a smock-like structure, and was subsequently oxidized or neutralized, and washed out. The fabric thus treated was then impregnated with a suspension of glazing or frit powder as in Example 1; and finally was subjected to heat-treatment.

The irregular smocking-structure thus imparted to the fabric was not removed even by numerous washings.

EXAMPLE 5

Mixed wool-and-silk fabrics and mixed cotton-and-wool fabrics were treated in the same manner as described in Example 1. All of these displayed improved properties in terms of shape-retention (especially with pleated goods) and heat-resistance, as well as excellent insensitivity to light.

EXAMPLE 6

An industrial silk similar to that employed in Example 1 was treated with keratolytic liquid, then washed out and oxidized or neutralized. The textile material thus treated was then impregnated several times with an aqueous PbO-frit suspension (having a ratio of 1:1) until about 6 g of frit powder (calculated on a dry basis) was taken up per $m^2$ of the material. The silk was then heat-treated on a heated roller at a temperature of 320° C.

An exceptionally heat-resistant filter silk was thus obtained, which could be used in industrial applications at temperatures in the region of 300° C. and more, and even in the presence of corrosive substances.

EXAMPLE 7

In a pilot-scale installation, a length of pleated silk material (with the pleats held by tacking threads) having a width of 1300 mm was pre-wetted and then passed at a speed of 15 m/minute through a bath containing a keratolytic liquid having the composition stated in Example 1. The dwell time of the material in the bath was about 15 minutes; but after emerging from the bath the length of material was transferred for a further 15 minutes to a wet-goods store. Finally the thus-treated material, after squeezing out if still necessary, was passed to a conventional washing station.

Thereafter the material was passed at the same speed to a dip-station and there immersed in a bath of frit suspension as described in Example 1. After the dip-station, the length of material was then passed through a squeezer, in order firstly to ensure the complete impregnation of the fabric and also secondly so as roughly to regulate the quantity of the frit suspension taken up.

Finally, the length of material was carried over heated rollers, arranged in a chamber with additional infra-red radiators; the upper surface treatment temperature at this heat-treatment station was about 250° C. The material thus heat-treated was then taken through a dust-extraction station, in order to remove any remaining dust particles; and finally the length was then either rolled-up in the finished pleated form and further processed, or taken to a dyeing station.

A variant of this procedure was also carried out, in which the length of cloth after treatment with the keratolytic liquid but before impregnation with the frit powder was taken through an oxidizing bath containing an oxidizing bromate solution; and a still further variant was also carried out, in which the length of cloth, after it leaves the squeezer station already impregnated with the frit or glazing material is next taken through an oxidizing bath before it undergoes the heat-treatment.

In both these variants, the cloth length, after it left the oxidizing bath, was again taken through a washing station.

In all these procedures, the pleated silk thus obtained showed no change in the folding either after chemical cleaning or after washing at 60° C.

I claim:

1. A process for improving the permanent pleat properties of pleated textile material which contains silk or wool, in which the textile material is subjected to the steps of:

(a) treatment with a keratolytic liquid of the kind used for the permanent-waving of human hair, washing it out of the textile material after it has acted thereon; then (b) impregnation with a suspension of a finely divided glazing powder of the kind used in ceramics as a glazing material; and then (c) heat treatment of the thus-treated textile material at a temperature of above 180° C.

2. A process as claimed in claim 1, in which the keratolytic liquid is allowed to act upon the textile material for a period of between 2 and 4 hours before it is washed out.

3. A process as claimed in claim 1, in which the keratolytic liquid employed is one based on alkali-metal sulphite or thioglycolic acid.

4. A process as claimed in claim 1, in which between steps (a) and (b) and/or between steps (b) and (c) the textile material is treated with an oxidizing agent which is subsequently again washed out.

5. A process as claimed in claim 4, in which the oxidizing agent employed is a hydrogen peroxide bromate, perborate or urea peroxide solution.

6. A process as claimed in claim 1, in which the glazing powder used is one with a particle size of from 10 to 400 μm, and it is employed in an aqueous suspension having a weight ratio of from 1:2 to 2:1.

7. A process as claimed in claim 6, in which the glazing powder employed is a lead frit containing 60 to 80% of PbO.

8. A process as claimed in claim 6, in which the glazing powder employed is one containing up to 40% by weight of a fluxing agent for glazing material.

9. A process as claimed in claim 1, in which the glazing or frit powder is applied to the textile material in an amount (calculated in terms of dry weight) of from 0.5 to 5 g per $m^2$ of the textile material.

10. A process as claimed in claim 1, in which the glazing powder employed is one which contains a colouring metal oxide.

11. A process as claimed in claim 10, in which different areas of a single length of textile material are treated with suspensions of differently-coloured glazing powder.

12. A process as claimed in claim 1, in which the textile material is air-dried before the heat-treatment is carried out in a hot-air oven or by means of a heated surface at a temperature of from 250° to 350° C.

13. A process as claimed in claim 1, which includes the preliminary step, before the treatment with the keratolytic liquid, of pleating the textile material.

14. A process as claimed in claim 1, which includes the intermediate step, between process steps (a) and (b), of shaping the textile material.

15. A process as claimed in claim 1 comprising applying the glazing powder to the textile material in an amount of 0.5 to 10% by weight relative to the weight of the textile material.

16. A pleated textile material made by the process of claim 1.

17. A process according to claim 1 wherein the textile material is silk.

18. A process according to claim 1 wherein the textile material consists of silk or wool.

19. A process according to claim 1 wherein the glazing powder is in the form of a frit powder.

* * * * *